US010204750B2

(12) United States Patent
Fasano et al.

(10) Patent No.: US 10,204,750 B2
(45) Date of Patent: Feb. 12, 2019

(54) ILLUMINATED SWITCH ACTUATOR FURTHER SURROUNDED BY AN ILLUMINATION STRUCTURE

(71) Applicant: Carling Technologies, Inc., Plainville, CT (US)

(72) Inventors: Michael Fasano, Watertown, CT (US); Walter A. Sadowski, Newington, CT (US); Brian Thomas Stuckman, Bristol, CT (US); Sean McDonnell, Plainville, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 15/803,333

(22) Filed: Nov. 3, 2017

(65) Prior Publication Data

US 2018/0130616 A1 May 10, 2018

Related U.S. Application Data

(60) Provisional application No. 62/417,786, filed on Nov. 4, 2016.

(51) Int. Cl.

| | |
|---|---|
| ***H01H 73/12*** | (2006.01) |
| ***H01H 9/18*** | (2006.01) |
| ***H01H 9/16*** | (2006.01) |
| ***H01H 9/04*** | (2006.01) |
| ***H01H 23/06*** | (2006.01) |
| ***H01H 23/02*** | (2006.01) |
| ***H01H 73/14*** | (2006.01) |

(52) U.S. Cl.

CPC ..... *H01H 9/182* (2013.01); *H01H 9/04* (2013.01); *H01H 9/161* (2013.01); *H01H 23/025* (2013.01); *H01H 23/06* (2013.01); *H01H 73/12* (2013.01); *H01H 73/14* (2013.01); *H01H 2009/048* (2013.01); *H01H 2009/183* (2013.01)

(58) Field of Classification Search

CPC .. H01H 23/025; H01H 23/143; H01H 23/145; H01H 19/46; H01H 9/161; H01H 73/12; H01H 73/14

USPC ..... 200/313, 315, 317, 339

See application file for complete search history.

(56) References Cited

U.S. PATENT DOCUMENTS

| | | | | |
|---|---|---|---|---|
| 4,287,400 | A | 9/1981 | Kitik et al. | |
| 5,053,591 | A * | 10/1991 | Theurer | H01H 23/025 200/302.3 |
| 5,491,460 | A * | 2/1996 | Krasser | H01H 73/14 200/339 |
| 6,380,500 | B1 | 4/2002 | Lin | |
| 6,621,025 | B2 * | 9/2003 | Yei | H01H 23/025 200/315 |
| 2010/0220495 | A1 | 9/2010 | Truesdale et al. | |
| 2012/0302087 | A1 | 11/2012 | Lee et al. | |
| 2013/0106287 | A1 | 5/2013 | Savicki, Jr. et al. | |

(Continued)

*Primary Examiner* — Vanessa Girardi

(74) *Attorney, Agent, or Firm* — Forge IP, PLLC

(57) ABSTRACT

A switch that includes an illumination structure that extends at least partially around a perimeter of the switch. The illumination structure being illuminated based on the status of the switch. The switch also including a switch surface that includes a transparent or translucent material that can be illuminated based on the status of the switch. The switch being adapted for use in a wet or damp environment.

30 Claims, 5 Drawing Sheets

(56) References Cited

U.S. PATENT DOCUMENTS

| | | | |
|---|---|---|---|
| 2015/0060245 | A1 | 3/2015 | Raupach et al. |
| 2016/0041569 | A1 | 2/2016 | Kevelos et al. |

* cited by examiner

ILLUMINATED SWITCH ACTUATOR FURTHER SURROUNDED BY AN ILLUMINATION STRUCTURE

FIELD OF THE INVENTION

The invention relates to illuminated switches, and more particularly, the invention is directed to a switch that includes an illuminating section extending around at least a portion of the perimeter of the switch.

BACKGROUND OF THE INVENTION

A rocker switch provides a discrete, low-profile switch for use in many differing applications. In an off position, a switch prevents any flow of electricity, or the transmission of an electric signal. When the switch is activated or closed, electricity is allowed to flow. Rocker switches have many applications; common applications include light switches, general power switches, and switches in circuit breakers. They are especially useful where low profile designs are needed.

During operation of a rocker switch, any activation, or deactivation of the switch, by moving the rocker, causes a mechanical movement inside of the housing. When the user activates the switch, the portion of the switch (the rocker) that is outside of the housing is moved. The rocker is connected to a pin, which causes a subsequent movement inside of the housing, either completing or disconnecting a circuit (activating or deactivating the switch).

As rocker switches are designed to pivot about a pivot point where activation of the switch typically is accomplished by pressing downward on one side of the rocker, the overall movement of the rocker does not have to be large. Add to this that the rocker is typically maintained mostly within the housing of the switch, it can become difficult to determine the current position of the rocker. This problem can be further aggravated when the rocker switch is installed in low light environments.

Still another problem to deal with is the use of a rocker switch in a damp environment. One of the methods used by manufacturers to waterproof switches in wet or damp environments, is to set the moving elements almost entirely within the switch housing and overlay a waterproof material over the surface of the switch. This design, however, makes it even more difficult to quickly and accurately determine the position of the switch solely by visual means.

What is desired, therefore, is a rocker switch and mechanism that addresses the above-listed limitations of prior designs and is safe for use in damp and/or wet locations.

SUMMARY OF THE INVENTION

Accordingly, it is an object of the invention to provide a switch that provides visual indication of the position of the switch that is easy to see even in a low-light environment.

It is further desired to provide a rocker switch that may be used in a wet or damp location that provides a clear visual indication of the current position of the switch.

It is still further desired to provide a rocker switch that that is illuminated so that the switch is visually easy to locate in a low light environment and that provides a visual indication as to the position of the switch.

These and other objections are achieved, in one configuration, by the provision of a switch that includes an illumination that extends at least partially around a perimeter of the switch. The illumination can be provided by LEDs that are positioned within the switch housing where the light emitted by the LEDs interacts with an illumination medium that transmits the light to an area along at least a portion of the perimeter of the switch. In one embodiment, the illumination medium could be a generally rectangular illumination ring, which may be configured to act as a reactive function light. The rectangular illumination ring can be uniformly lit such that light is emitted from the entire ring equally. Alternatively, the rectangular illumination ring can be configured to emit light only in the direction of the activated switch. Likewise, it is possible for the ring to remain fully lit in all the switch positions.

The switch can also be sealed so that it is useable in either a damp or wet environment. In one configuration, the seal is maintained within the housing of the switch, however, the design is completely sealed above the switch panel. The sealing is accomplished with a design that incorporates a liquid silicone rubber over-mold. It is contemplated that the seal forms both a pivot seal (a seal for the rocker pivot) and two light diffusive lenses for icon illumination. In one configuration, it is contemplated that the face of the rocker switch could have a transparent or translucent portion such that, when the switch is activated in a position, an LED is turned on so that light is emitted from the transparent or translucent portion on the switch face visually indicating the position of the switch.

It is also contemplated that the rectangular illumination ring is able to emit uniform lighting around the perimeter of the switch with the absence of any hot spots or shadowing. This illumination is achieved through the use of indirect illumination of the rectangular lens using right-angle LED's. In one embodiment, four right-angle LEDs are used. These LEDs are positioned around the center of the switch and are positioned to face outward towards the lens (i.e., rectangular illumination ring). In this configuration, the rectangular lens is molded and extends completely around the switch without any breaks, through the use of a two-shot mold. The two-shot mold allows the rectangular lens to also act as a support structure between an inner and an outer bracket while still maintaining lens clarity.

In certain situations, forming the inner and the outer bracket as two separate parts may be advantageous to ensure completely even illumination of the rectangular illumination ring. For example, if the inner and outer bracket were molded as one part, this may cause a shadow to form within the rectangular illumination ring because a plastic "bridge" would have to span the two parts, which would function to at least partially obstruct the lens. This is especially true as the brackets comprise an opaque material.

While the above switch has been described in connection with a one-way switch, it is contemplated that a two position or a three position switch could be used. For example, in a three position configuration, when the switch is in a center position, the rectangular illumination ring could be evenly illuminated completely around the switch. When the switch is depressed such that one side of the switch is activated, the rectangular illumination ring could be illuminated on only the side of the switch that is activated. This would provide a clear visual indication of the current position of the switch. Likewise, if the switch were activated to the opposite position (e.g., the opposite side of the switch was depressed), then the opposite side of the rectangular illumination ring could be illuminated. This again provides a clear visual indication of the position of the switch, even in very low light level environments.

Alternatively, the rectangular illumination ring could be consistently evenly illuminated and icons on the face of the switch could be turned on and off based on the switch position.

Still further, the rectangular illumination ring could be illuminated only when the switch is activated and icons on the face of the switch could be turned on and off based on the switch position.

It is contemplated that the switch configuration would be very useful in damp or wet environments, such as on a control panel for a boat that frequently sees water and spray. The switch configuration would easily allow an operator to quickly assess the location of the switch on the control panel and quickly assess the position of the switch, even at night with very poor lighting conditions. The variable lighting of the rectangular illumination ring to indicate the position of the switch can also be useful for providing a visual switch indication when the operator is not in close proximity to the control panel, but still needs to be able to visually verify the position of a switch.

For this application the following terms and definitions shall apply:

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one configuration a rocker switch is provided comprising an inner bracket, an outer bracket enclosing said inner bracket, and a switch cooperating with the inner bracket, the switch including a first and a second contact moveable with respect to each other and corresponding to a closed state and an open state. The switch further comprises an illumination structure extending around at least a portion of a perimeter of the switch and at least one LED positioned in the vicinity of the illumination structure. The at least one LED is provided such that it emits light that diffuses through the illumination structure indicating the position of the rocker switch.

In certain configurations, the at least one LED illuminates only a portion of the illuminating structure to indicate the position of the rocker switch.

In another configuration a switch is provided comprising an inner bracket, an outer bracket enclosing the inner bracket, and a rocker switch cooperating with the inner bracket, the rocker switch including a first set and a second set of contacts, each set of contact including a first and a second contact moveable with respect to each other and corresponding to a closed state and an open state. The switch further comprises a base, wherein the outer bracket is coupled to the base and the first and second sets of contacts are mounted within the base. The switch further comprises an illumination structure extending completely around a perimeter of the rocker switch, the illumination structure comprising a first end and a second end. The switch also comprises a first LED and a second LED, the first LED positioned adjacent to the first end of the illumination structure and the second LED positioned adjacent to the second end of the illumination structure. The rocker switch is provided such that it is moveable to one of three positions: a first position where the first set of contacts are closed and the second set of contacts are open, a second position where the first set and the second set of contacts are open, and a third position where the first set of contacts are open and the second set of contacts are closed. The rocker switch is further provided such that the illumination structure is illuminated so as to indicate the position of said rocker switch.

In certain configurations, the first LED illuminates only a first portion of the illuminating structure to indicate the rocker switch is in the first position, and the second LED illuminates only a second portion of the illuminating structure to indicate the rocker switch is in the third position.

Other objects of the invention and its particular features and advantages will become more apparent from consideration of the following drawings and accompanying detailed description.

DETAILED DESCRIPTION OF THE INVENTION

Figure 1:
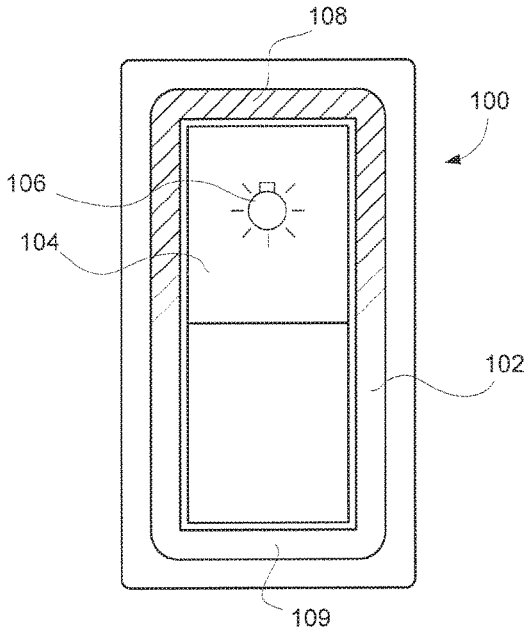
FIG. 1 is an illustration of the illuminated switch according to one configuration of the invention showing the switch in the on position with the illumination structure and the icon indicating the state of the switch.

Referring now to the drawings, wherein like reference numerals designate corresponding structure throughout the views.

Figure 2:
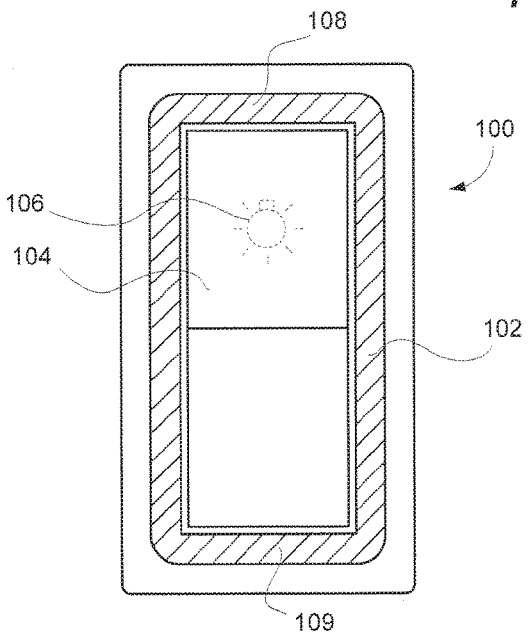
FIG. 2 is an illustration of the illuminated switch according to FIG. 1 showing the switch in the off position with the illumination structure illuminated to outline the switch and the icon indicating the state of the switch.
Figure 3:
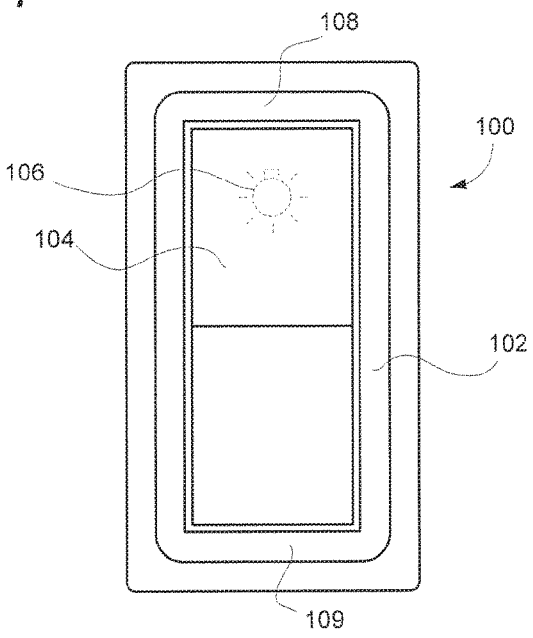
FIG. 3 is an illustration of the illuminated switch according to FIG. 1 showing the switch in the off position with the illumination structure and the icon indicating the state of the switch.

FIGS. 1-3 illustrate one configuration for the switch illumination system provided as a two-position switch (On/Off). In FIG. 1, a switch 100 is illustrated that includes an illumination structure 102 that may be formed, in this example, as a rectangular structure having a first end 108 and a second end 109. The switch 100 also includes a switch surface 104 that includes a transparent or translucent material that may be formed as an icon 106 on the switch surface 104. The switch examples provided herein depict a switch formed as a rocker actuator, however, it is contemplated that various different switch configurations could effectively be used.

In FIG. 1, the switch surface 104 has been depressed, which functions to activate the switch 100. To provide a visual indication that the switch 100 is On, the illumination structure 102 that runs along a perimeter of the switch surface 104 is depicted as being illuminated. The diagonal lines are provided to indicate that light is being diffused through and out of the illumination structure 102. It can be seen that the diagonal lines are progressively shown as broken lines and with a lighter line weight to indicate that the illumination of the illumination structure 102 fades gradually once beyond the perimeter of the switch surface 104 that is actuated.

It can also be seen that icon 106 is illuminated in FIG. 1 providing an indication that the switch is currently activated.

FIG. 2 is an alternate configuration in which that illumination structure 102 is uniformly and completely lit extending completely around the switch structure regardless of the position of the switch. This configuration can be very useful in low light environments in order to illuminate the position of the switch so that it is easy to locate. The icon 106 will be illuminated when the switch surface 104 is depressed to actuate the switch.

Still further, FIG. 3 shows the Off position for FIG. 1 where neither the illumination structure 102 nor the icon 106 are brightly lit but will transition to the state illustrated in FIG. 1 when activated. It is contemplated that the illumination structure 102 or the icon 106 could be very dimly lit in FIG. 3 and then could transition to a brightly lit state shown in FIG. 1. Alternatively, it could be that neither the illumination structure 102 nor the icon 106 are lit at all until the switch is activated.

Turning now to FIGS. 4-7 we see alternative configurations of FIG. 1. In these examples, the switch is provided as a three-position switch (1 On/Off/2 On).

In this configuration, the switch surface 104 is a first switch surface, and there is also provided a second switch surface 105 that is opposite first switch surface 104. Likewise, the icon 106 comprises a first icon, and there is also provided a second icon 107. The functionality of the switch 100 in FIGS. 4-7 is similar to that described in connection with FIGS. 1-3 with the exception that there are three switch positions instead of just two.

Figure 4:
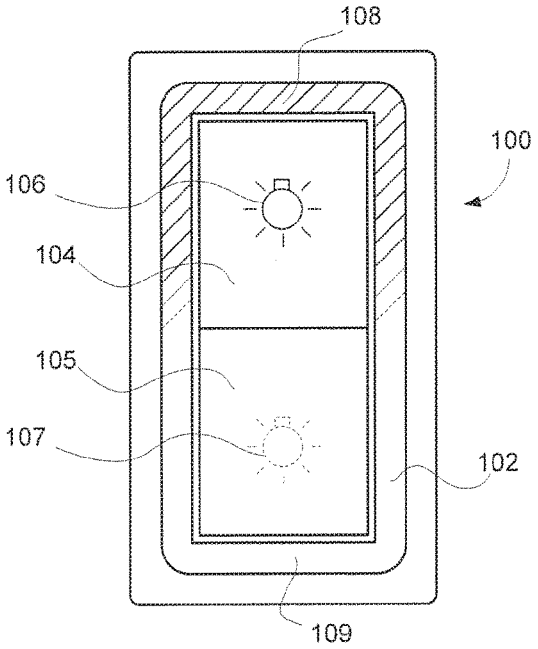
FIG. 4 is an illustration of the illuminated switch according to FIG. 1 showing the switch in the on in a first position with the illumination structure and the icon indicating the state of the switch.

For example, in reference to FIG. 4, the first switch surface 104 has been depressed thereby actuating the switch to a first position. The illumination structure 102 is illuminated in the area of first end 108 and first icon 106 is illuminated. This would provide a clear visual indication to the user that the switch 100 is in the first position.

Figure 5:
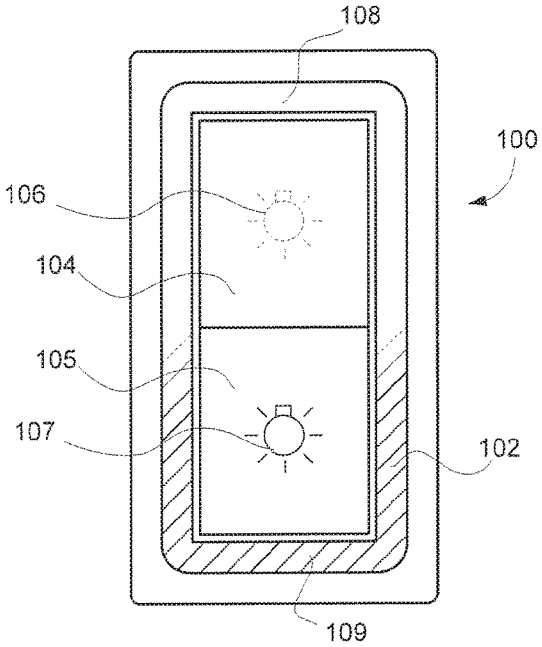
FIG. 5 is an illustration of the illuminated switch according to FIG. 4 showing the switch in the on in a second position with the illumination structure and the icon indicating the state of the switch.

FIG. 5 shows the switch in the third position where the second switch surface 105 has been depressed. The illumination structure 102 is illuminated in the area of second end 109 and second icon 107 is illuminated. This would provide a clear visual indication to the user that the switch 100 is in the third position.

Figure 6:
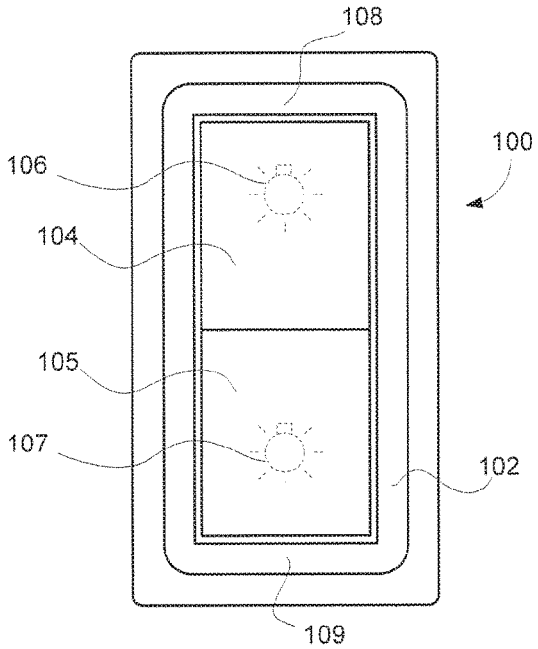
FIG. 6 is an illustration of the illuminated switch according to FIG. 4 showing the switch in the off position with the illumination structure illuminated to outline the switch and the icons indicating the state of the switch.
Figure 7:
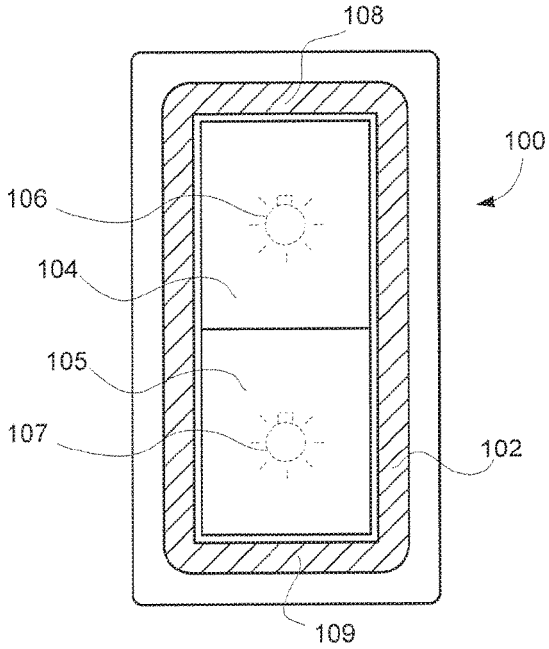
FIG. 7 is an illustration of the illuminated switch according to FIG. 4 showing the switch in the off position with the illumination structure and the icons indicating the state of the switch.

FIGS. 6 and 7 show alternative configurations for the second position where the illumination structure 102 and icons are off (or dimly lit) when neither of the switch surfaces 104, 105 have been actuated providing a visual indication that the switch is in the second position (off state) as shown in FIG. 6; or the illumination structure 102 could be evenly illuminated at all times but the icons are off (or dimly lit) when neither of the switch surfaces 104, 105 have been actuated providing a visual indication that the switch is in the second position (off state) as shown in FIG. 7.

Figure 8:
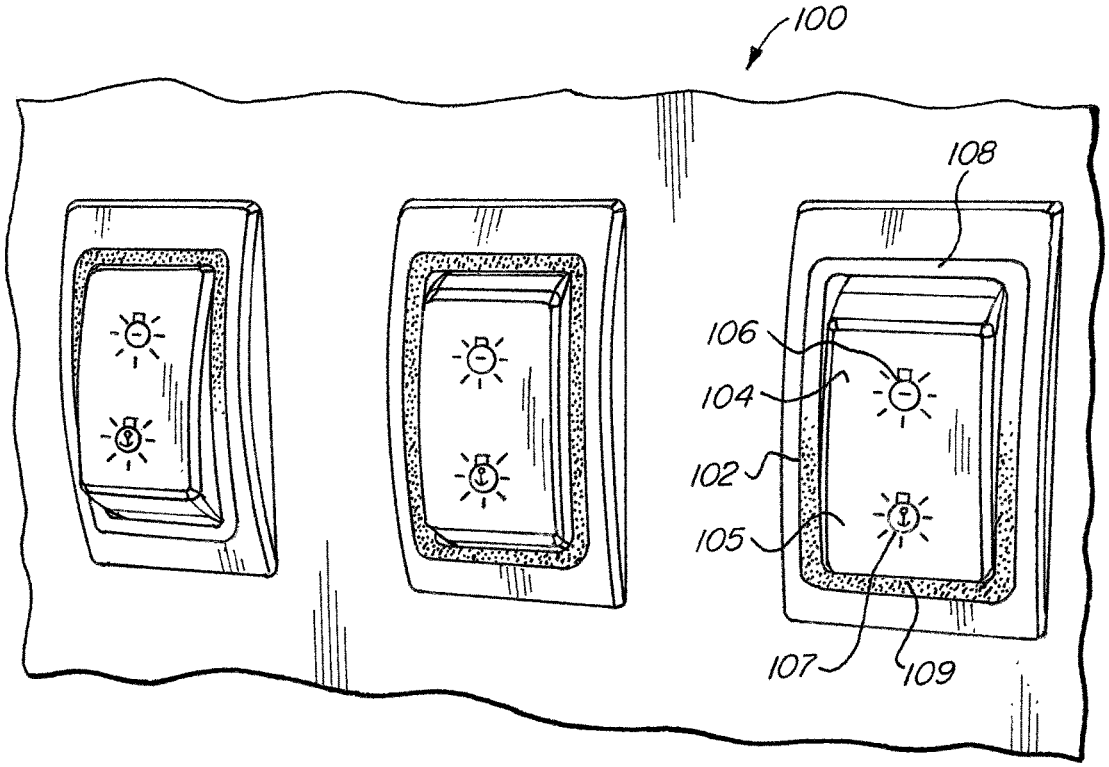
FIG. 8 is a perspective view of the illuminated switch according to FIGS. 4, 5 and 7.

FIG. 8 is a perspective view of a gang of switches that can be provided variously illustrating the configurations of FIGS. 4, 5 and 7.

Figure 9:
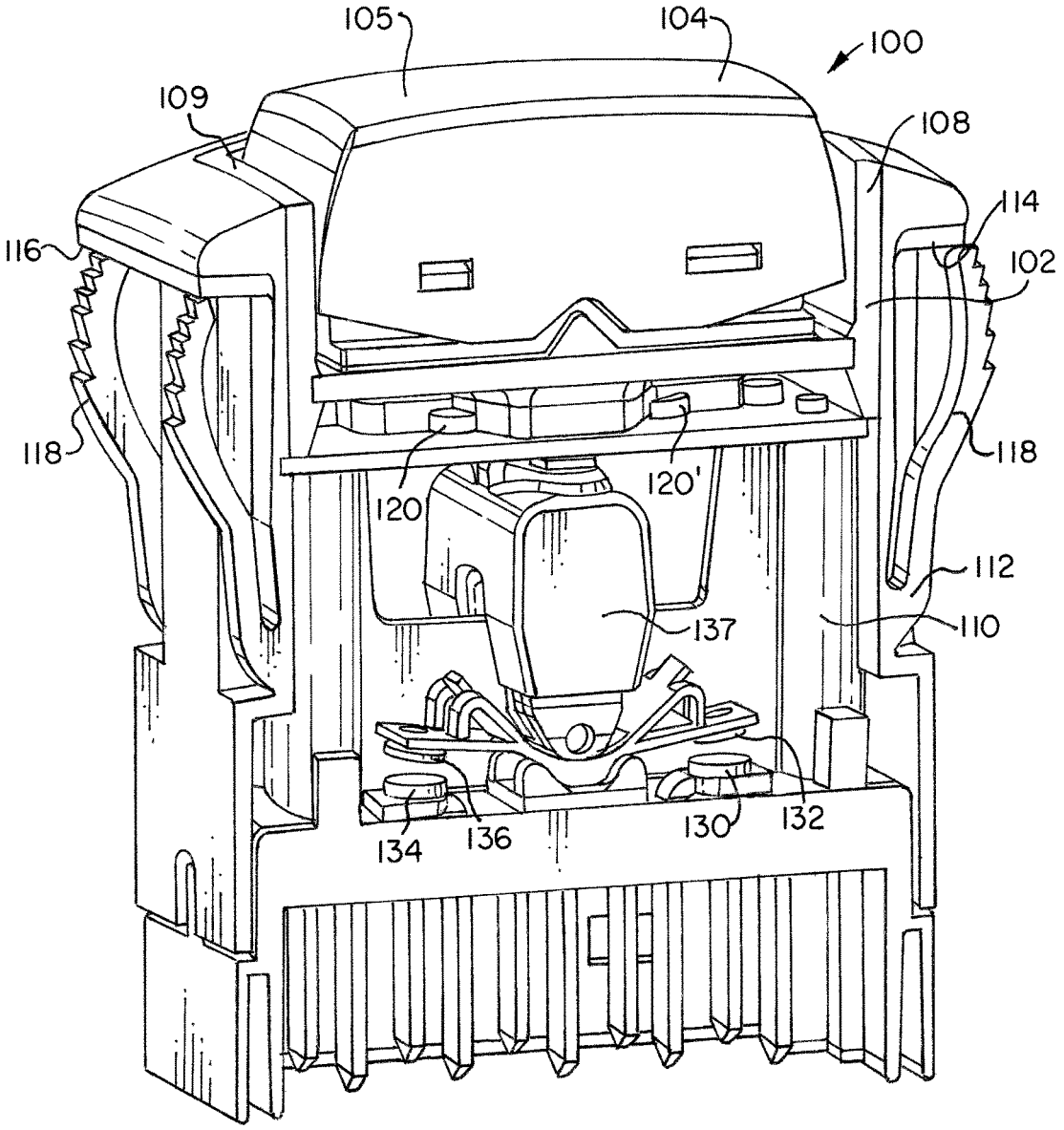
FIG. 9 is a cut away view of the illuminated switch according to FIG. 4.

Referring now to FIG. 9, a cut away view is provided of the switch 100 illustrating the internal section of the base 110 onto which an outer bracket 112 is secured. It is contemplated that the base 110 and outer bracket 112 may comprise a plastic material. The outer bracket is provided with an undercut 114 that includes a gasket 116 that is intended to provide a water tight seal when the structure is inserted into an opening in a surface, such as a flat control panel surface. The outer bracket includes tines 118 that can engage with an underside of the flat surface the switch 100 will be mounted to.

Also illustrated in FIG. 9 are LEDs 120, 120'. These LEDs are provided as right angle LEDs and are designed to emit light that is picked up and transmitted by the illumination structure 102. While not shown, there are two additional LEDs that correspond to LEDs 120, 120' on an opposite side of the structure such that two LEDs are positioned toward first end 108 and two LEDs are positioned toward second end 109. In this manner, very even and uniform illumination can occur in illumination structure 102 when all four LEDs are on due to the fact that indirect illumination of illumination structure 102 is provided.

The base 110 includes two sets of contacts including first stationary contact 130, first moveable contact 132, second stationary contact 134 and second moveable contact 136. Actuator assembly 137 is also provided and used to apply force to switch levers that are coupled to the moveable contacts. As can be better seen in FIG. 10, the switch includes a subrocker 150 that interacts with the actuator assembly 137, which causes movement of the moveable contact arms depending on the position of the switch. In one configuration, the subrocker 150 delivers the pivot of the switch through snap latches on the inner bracket 140.

Various pin configurations are illustrated corresponding to contact connection points and power feed points for the switch electronics, however, it is contemplated that many differing connection means could effectively be utilized with the invention.

In function, when first switch surface 104 is depressed, this would function to close first stationary contact 130 and first moveable contact 132. When the switch is in a middle position, both sets of contacts are in the open position (as illustrated in FIG. 9). Finally when second switch surface 105 is depressed, this would function to close second stationary contact 134 and second moveable contact 136. It is contemplated that the illumination of the illumination structure 102 could be achieved as described in connection with FIGS. 4-7.

Figure 10:
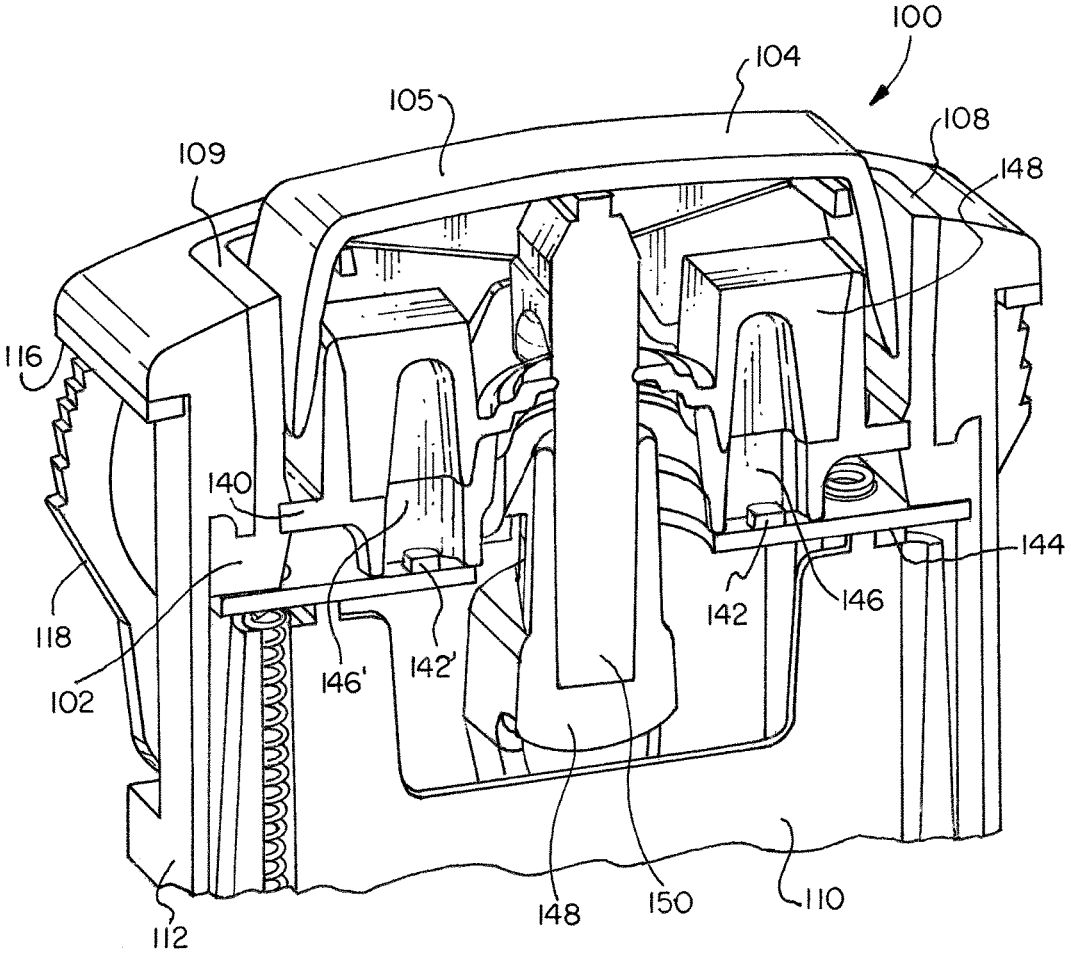
FIG. 10 is a cut away view of the illuminated switch according to FIG. 9.

Turning now to FIG. 10, a cut away of the upper portion of the switch is illustrated.

As can be seen, an inner bracket 140 is provided and maintained within outer bracket 112. The inner bracket 140 provides structure for and is used for creating a main pivot for switch. The illumination structure 102 is secured between the inner bracket 140 and the outer bracket 112.

Also illustrated in FIG. 10 are switch surface LEDs 142, 142' that are positioned on a circuit board 144. The switch surface LEDs 142, 142' are positioned such that light emitted by the LEDs will travel up a light baffle 146, 146' formed in inner bracket 140. The light then passes through seal 148 and will then pass through the transparent or translucent material that is provided on the face of the switch as described in connection with FIGS. 1-7. The light baffles 146, 146' function to maintain the icon and illumination structure lighting separate from each other.

The seal 148 is provided to lay over top of inner bracket 140 and effectively seals off the area above the seal 148 from the base 110. In this manner, any water entering the top portion of the switch 100 (above the seal 140) will be prevented from passing onto the circuit board 144 and into the base 110 where the contacts are located.

In one configuration, seal 148 comprises a liquid silicone rubber seal and light diffusive lens for icon lighting. It should be noted that the rocker switch includes a subrocker 150 that extends from the upper part of the switch downward into the base 110. However, the seal is provided to extend downward completely enclosing the subrocker to ensure that not water is allowed to pass from the upper part of the switch above the seal 148, downward into the base 110.

While the various examples have illustrated in terms of a rocker actuator, it is contemplated that actuators other than rocker actuators could effectively be used by the invention. Likewise, it is contemplated that while two-position and three-position switches have been used as examples of switch configurations, it is contemplated that other multiple position switches could effectively be utilized.

The use of the illuminated ring that extends around the switch can be very effective in providing a visual indication of the location of the switch in very low-light environments, such as, on a boat at night. Likewise, the illumination ring that is lit up according to the switch position would provide a very easy to see visual indication of the switch position even in low-light environments or even viewing the switch from a distance or at an angle.

It is further contemplated that the illumination ring could provide the light as a particular color indicating the status for the switch. For example, if the switch is a three-way switch, such as provided in FIGS. 4-7, the illumination could be provided as a green color in FIG. 4 to indicate that the switch is provided in the first position. The same could be done for the switch position indicated in FIG. 5. However, if the switch is in the middle position where none of the contacts are closed, it could be that the illumination ring is illuminated with a different color, such as red, to indicate that the switch is in the Off position.

The same configuration could be used for the icon illumination. If a switch is in the On position, when the icon is illuminated, it could be lit with a green illumination. Alternatively, if a switch is in the Off position, the icon could be lit (low light level) with a different color, such as red, to indicate the switch condition. Many different lighting configurations could be used without deviating from the invention.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A rocker switch assembly comprising:

an inner bracket;

an outer bracket enclosing said inner bracket;

a switch cooperating with said inner bracket, said switch including a first and a second contact moveable with respect to each other and corresponding to a closed state and an open state;

an illumination structure secured between said inner bracket and said outer bracket with said illumination structure surrounding at least a portion of a perimeter of said switch, wherein said switch is pivotable with respect to said inner bracket, said outer bracket and said illumination structure;

at least one Light Emitting Diode (LED) positioned in the vicinity of said illumination structure;

said at least one LED emitting light that diffuses through said illumination structure indicating the position of said switch.

2. The switch assembly according to claim 1 wherein said at least one LED illuminates only a portion of the illuminating structure.

3. The switch assembly according to claim 1 wherein said at least one LED comprises at least two LEDs that are positioned in the vicinity of said illumination structure.

4. The switch assembly according to claim 1 further comprising a base, wherein said outer bracket is coupled to said base and said contacts are mounted within said base.

5. The switch assembly according to claim 4 wherein said illumination structure completely surrounds the perimeter of said switch and is formed as a single unitary structure, said illumination structure formed as a rectangular structure have a first end and a second end.

6. The switch assembly according to claim 5 wherein said at least one LED comprises a first and a second LED, said switch further comprising:

a third and a fourth LED, wherein said first and second LEDs are positioned adjacent to the first end of said illumination structure and said third and fourth LEDs are positioned adjacent to the second end of said illumination structure.

7. The switch assembly according to claim 6 wherein said at least four LEDs comprise right angle LEDs.

8. The switch assembly according to claim 7 wherein said switch comprises a rocker switch having at least two opposing switch surfaces.

9. The switch assembly according to claim 8 wherein said rocker switch comprises three positions and said set of contacts comprises a first set of contacts, said switch further comprising a second set of contacts;

wherein in a first switch position, the first set of contacts are closed and the second set of contacts are open and the first and second LEDs emit light through the first end of said illumination structure;

wherein in a second position, the first set of contacts and the second set of contacts are open;

wherein in a third position, the first set of contacts are open and the second set of contacts are closed and the third and fourth LEDs emit light through the second end of said illumination structure.

10. The switch assembly according to claim 4 wherein said outer bracket comprises an undercut and further comprises a gasket such that the switch may be mounted into a cut out in a surface where the gasket provides a water tight seal.

11. The switch assembly according to claim 4 further comprising a seal overlaid on said inner bracket that forms a water tight seal inhibiting water from passing from said inner bracket into said base.

12. The switch assembly according to claim 11 wherein said seal comprises liquid silicon rubber.

13. The switch assembly according to claim 12 wherein said seal comprises a light diffusive lens.

14. The switch assembly according to claim 13 wherein said switch comprises a rocker switch, said rocker switch having at least one switch surface with an area comprising either a translucent or transparent material.

15. The switch assembly according to claim 14 further comprising a switch surface LED positioned within said inner bracket, said inner bracket including at least one light baffle such that said switch surface LED emits light through the at least one light baffle and through the translucent or transparent material of the switch surface.

16. The switch assembly according to claim 15 wherein said switch comprises at least two positions such that in a first position, the set of contacts are closed and in the second position, the set of contacts are open, and wherein when the set of contacts are closed, light from the switch surface LED illuminates the translucent or transparent material of the switch surface.

17. The switch assembly according to claim 16 wherein, said switch surface comprises a first switch surface and said switch comprises a second switch surface, each switch surface having either a translucent or transparent material, said switch surface LED comprises a first switch surface LED and including a second switch surface LED, both the first and second switch surface LEDs positioned within said inner bracket, and said inner bracket comprising at least two light baffles, wherein each switch surface LED is positioned in one of the light baffles such that each switch surface LED emits light through their associated light baffle and through one of the translucent or transparent material in an associated switch surface.

18. The switch assembly according to claim 17 wherein said switch comprises at least three positions wherein, said set of contacts comprises a first set of contacts and said switch includes a second set of contacts, wherein in a first switch position, the first set of contacts are closed and the second set of contacts are open and the first switch surface LED emits light through the translucent or transparent material associated with the first switch surface;

wherein in a second position, the first set of contacts and the second set of contacts are open;

wherein in a third position, the first set of contacts are open and the second set of contacts are closed and the second switch surface LED emits light through the translucent or transparent material associated with the second switch surface.

19. The switch assembly according to claim 18 wherein the translucent or transparent material associated with the at least two switch surfaces each comprise an icon.

20. A rocker switch assembly comprising:

an inner bracket;

an outer bracket enclosing said inner bracket;

a rocker switch cooperating with said inner bracket, said rocker switch including a first set and a second set of contacts, each set of contact including a first and a second contact moveable with respect to each other and corresponding to a closed state and an open state;

a base, wherein said outer bracket is coupled to said base and said first and second sets of contacts are mounted within said base an illumination structure secured between said inner bracket and said outer bracket with said illumination structure completely surrounding a perimeter of said rocker switch, said illumination structure comprising a first portion having a first end and a second portion having a second end, wherein said rocker switch is pivotable with respect to said inner bracket, said outer bracket and said illumination structure;

a first Light Emitting Diode (LED) and a second LED, said first LED positioned adjacent to the first end of said illumination structure and said second LED positioned adjacent to the second end of said illumination structure;

wherein said rocker switch is moveable to one of three positions:

a first position where the first set of contacts are closed and the second set of contacts are open;

a second position where the first set and the second set of contacts are open; and a third position where the first set of contacts are open and the second set of contacts are closed;

wherein the illumination structure is illuminated so as to indicate the position of said rocker switch.

21. The rocker switch assembly according to claim 20 wherein when said rocker switch is in the first position, only the first portion is illuminated.

22. The rocker switch assembly according to claim 20 wherein when said rocker switch is in the second position, said illumination structure is not illuminated.

23. The rocker switch assembly according to claim 20 wherein when said rocker switch is in the third position, only the second portion is illuminated.

24. The rocker switch assembly according to claim 20 further comprising:

a third LED positioned adjacent to the first end of said illumination structure; and a fourth LED positioned adjacent to the second end of said illumination structure;

wherein said first and third LEDs are switched together and said second and fourth LEDs are switched together.

25. The rocker switch assembly according to claim 24 wherein said at least four LEDs comprise right angle LEDs.

26. The rocker switch assembly according to claim 20 further comprising a seal overlaid on said inner bracket that forms a water tight seal inhibiting water from passing from said inner bracket into said base.

27. The rocker switch assembly according to claim 26 wherein said seal comprises liquid silicon rubber.

28. The rocker switch assembly according to claim 27 wherein said seal comprises a light diffusive lens.

29. The rocker switch assembly according to claim 28 wherein said rocker switch comprises at least two opposing switch surfaces that include an area comprising either a translucent or transparent material.

30. The rocker switch assembly according to claim 29 further comprising a first switch surface LED and a second switch surface LED, each positioned within said inner bracket and each having a light baffle such that light emitted by the first and second switch surface LEDs is transmitted through the associated light baffle and through the translucent or transparent material of the associated switch surface.

* * * * *